US005232768A

United States Patent [19]

Eklund et al.

[11] Patent Number: 5,232,768

[45] Date of Patent: Aug. 3, 1993

[54] WET PRESS FABRIC TO BE USED IN PAPERMAKING MACHINE

[75] Inventors: Nils O. Eklund, East Greenwich, R.I.; Johan L. Olsson; Lars-Magnus Ström, both of Halmstad, Sweden

[73] Assignee: Nordiskafilt AB, Halmstad, Sweden

[21] Appl. No.: 950,424

[22] Filed: Sep. 24, 1992

Related U.S. Application Data

[63] Continuation-in-part of Ser. No. 357,430, May 25, 1989, Pat. No. 5,182,164.

[30] Foreign Application Priority Data

Jun. 9, 1988 [SE] Sweden ..... 8802153
Jun. 9, 1988 [SE] Sweden ..... 8802154

[51] Int. Cl.[5] ..... B32B 5/02

[52] U.S. Cl. ..... 428/234; 139/383 A; 162/900; 428/131; 428/137; 428/238; 428/246; 428/280; 428/282; 428/284; 428/298; 428/300; 428/304.4; 428/913

[58] Field of Search ..... 428/234, 238, 246, 131, 428/137, 284, 280, 282, 298, 300, 304.4, 913; 139/383 A; 162/358

[56] References Cited

U.S. PATENT DOCUMENTS

| | | | |
|---|---|---|---|
| 4,446,187 | 5/1984 | Eklund | 428/136 |
| 4,701,368 | 10/1987 | Kiuchi et al. | 428/233 |
| 4,830,905 | 5/1989 | Gulya et al. | 428/234 |
| 4,851,281 | 7/1989 | Wood | 428/282 |
| 4,988,409 | 1/1991 | Nyberg | 162/358 |

*Primary Examiner*—James J. Bell
*Attorney, Agent, or Firm*—Kane, Dalsimer, Sullivan, Kurucz, Levy, Eisele and Richard

[57] ABSTRACT

A dewatering wet press fabric to be used on papermaking machines includes at least one top layer made from staple fibers and the like and facing the paper web to be dewatered, and a second layer. The second layer constitutes a barrier layer of such a nature that during the compression phase in the press nip in the press section of the papermaking machine the water is forced through the second layer, but is prevented from flowing back to the top layer and the paper web during the expansion phase after the press nip.

37 Claims, 5 Drawing Sheets

WET PRESS FABRIC TO BE USED IN PAPERMAKING MACHINE

This is a continuation-in-part of copending application(s) Ser. No. 07/357,430 filed on May 25, 1989 now U.S. Pat. No. 5,182,164.

BACKGROUND OF THE INVENTION

1. Field of the Invention

The subject invention concerns a dewatering fabric to be used as a wet press fabric in the press section of a papermaking machine.

2. Description of the Prior Art

A papermaking machine comprises three different sections. In the forming section the stock suspension is fed onto traveling forming fabric or between two such fabrics. The majority of the water is removed from the stock, so that a continuous paper sheet is formed on the fabric. The formed sheet is carried into the press section, where some more water is removed by pressing. Finally, the sheet is dried in the drier section by being pressed against hot cylinders, so that the moisture in the paper sheet is vaporized.

An important part of the papermaking process is the dewatering efficiency in the press section. It is much more economical to remove the water in the press section than to vaporize it in the dryer section. The energy consumption is considerably higher in the dryer section than in the press section.

In the press section of the papermaking machine the formed sheet is pressed to a higher dry content through repeated pressings, usually in roll press nips. The sheet is carried through the press nip together with one or several endless textile fabrics, that are commonly referred to as press fabrics, and may also be referred to as press felts or wet felts.

The press fabric usually includes a soft surface layer next to the paper web, which surface layer is compressed to a rigidity without any air volume. Under the surface layer is usually arranged a base fabric, which is designed to retain most of its void volume, even when a maximum pressure is applied on the press fabric.

The purpose of this design is to enable the fabric to accept an optimal amount of water from the paper web during the compression of the web and the fabric in the press nip, and, after exiting the nip, to retain as much of the removed water as possible for later release in a suitable manner, before the fabric reenters the press nip.

In a currently common type of roller press, the bottom press roller is formed with cavities in the form of suction holes, connected on the inside to a vacuum source, or with lengthwise extending grooves (known as a Venta or grooved roll) or with blind drilled holes. The cavities in such a roll completely or partly replace the base fabric part of the press fabric or supplement the press fabric as a water-absorbing medium, when the paper sheet and fabric are compressed in the press nip. Normally, grooved and blind-drilled press rolls are used at the end of the press section at high linear pressures and high speeds.

When the paper sheet together with one or several press fabrics is carried into the press nip, the water from the paper web is forced into the fabric and then, together with the amount of air stored in the surface layer of the fabric, is forced backwards into the void volume of the base fabric and/or into the void volume of the press roll. Some water is also allowed to flow forwards or backwards in the lengthwise direction inside the fabric. The relationship between these flow directions depends, for example, on the speed of the machine and on the design of the fabric and on its ability to handle the water removed from the web.

Several theories have been proposed to explain what is going on in the paper web and press fabric during the press process itself. The exerted nip pressure is the same for both paper web and press fabric, while the hydrodynamic pressure is considerably higher in the web than in the fabric. This pressure difference provides the driving force for the transportation of the water from the web to the fabric.

The paper web, or sheet, and press fabric probably reach minimum thickness at the same time somewhat after mid nip. The sheet is considered to reach its maximum dry content at the very same moment. After that, the sheet, as well as the fabric, begin to expand. During this expansion, a vacuum is created in the paper sheet and in the surface layer of the press fabric, both of which have been totally compressed when the compression is at a maximum. In response to this vacuum, water flows back from the inside and base layers of the fabric to the surface layer of the fabric and into the sheet to reestablish the pressure balance. This phase provides the driving force of the re-wetting of the paper sheet inside the press nip.

In the press fabric constructions of the prior art, it is common practice to form the fabric with a surface layer facing the paper web considerably denser than the backside structure, and it has not been unusual to use lengthwise extending fibers on the web facing side to decrease flow resistance. High capillary forces, together with the large vacuum in the press fabric structure during the expansion phase, absorb water from an open backside structure toward the surface layer, rapidly decreasing the vacuum in the surface layer. When the vacuum of the sheet thus rises considerably during exit form the press nip and the flow resistance in the contact face of the press fabric against the sheet decrease, high re-wetting and low paper dry content result.

The purpose of the present invention is to create and, above all, to maintain a vacuum pressure which is as high as possible in the surface layer of the press fabric during the expansion phase by counter-acting the water-flow from the interior of the press fabric to the side facing the paper web to inhibit and reduce re-wetting.

SUMMARY OF THE INVENTION

The present invention is a dewatering press fabric which comprises:

at least a first and a second layer;

wherein the first layer is made up of staple fibers or interwoven yarns, which first layer in position of use of the press fabric faces and abuts the material to be dewatered; and wherein the second layer forms a barrier layer after the running-in of the press fabric, when the dewatering process has reached its continuous state;

the barrier layer having, relative to the first layer, a high flow resistance in its thickness direction;

the flow resistance being such that the water and the air that have been forced through the second, or barrier, layer during the compression of the paper web and the press fabric, due to the pressure of the roll press, are prevented from flowing back through the second layer to any significant extent, when vacuum is created during the expansion of the press fabric after exit from the press nip.

In certain embodiments of the present invention, the second layer—the barrier layer—is a close structure with high capillary forces. During compression of the press fabric on a press section in operation, the relatively high roll press pressure is able to force water and air from the sheet and the surface structure of the press fabric through the second layer.

In the expansion phase, the high vacuum in the second layer binds the water, while the considerably lower vacuum in the surface structure of the press fabric is not capable of returning water and air through the second-barrier-layer towards the surface layer, thus effectively sealing the press fabric surface structure and the paper sheet. Especially when a so called Venta press or the like is used, the second layer preferably forms the bottom layer of the press fabric facing the lower press roll.

While the flow resistance in the barrier layer is high in the thickness direction, flow resistance in the direction of travel of the layer could be an advantage, as it allows water to flow easily in this direction.

In accordance with a first embodiment of the present invention, the barrier layer consists of a fibrous batt, the fibers of which mainly extend in the travel direction of the fabric. These stacked fibers effectively restrict the water flow in the thickness direction of the layer, but the water can flow relatively freely in channels between the fibers in the lengthwise direction of the fabric.

In accordance with a second embodiment, the barrier layer consists of fine filament threads, extending in the lengthwise direction of the press fabric. These fine filament threads with a diameter preferably less than 0.14 mm, could be interconnected into bunches of filaments with no, or a relatively low, twist. The filament threads could be part of a lower layer in a multilayer base fabric.

In laminated felts having two or more base fabrics, the fine filament threads could be included as lengthwise extending strands in the bottom base fabric. In this embodiment, just as in the first embodiment, the lengthwise extension of the filaments or of the fibers, respectively, provides an effective barrier against air- and water-flow in the thickness direction of the layer, while the flow resistance is low along the fibers. Due to the densely stacked filaments or fibers, respectively, the capillary forces become high in the thickness direction, which partly contributes both to the absorption of water and to the retainment of the absorbed water, and enables the barrier layer to act as an effective barrier against water- and air-flow, for example, from a grooved lower press roll.

In accordance with a third embodiment of the invention, the barrier layer consists of a perforated film with numerous, minute holes, or it could be constituted by polymeric particles, which are sintered into a porous, film-resembling layer. The fine channels in the film contribute to a high flow resistance which allows the water to be let through at the highest pressure during the compression phase but effectively blocks the water-flow at a considerably lower vacuum during the expansion phase.

In accordance with a further embodiment, the barrier layer could consist of polymeric foam, that also blocks the water-flow that is caused by the vacuum during the expansion phase.

In accordance with yet another embodiment, the barrier layer consists of an extremely hydrophilic, synthetic polymeric material with a high ability to retain water. The hydrophilic material could be either in the form of fibers or in the form of filaments, and it could be combined with the above-described first and second embodiments. The hydrophilic material could also be in the form of bonded fibrous material, a sintered polymeric powder, a permeable resin coating, or in the form of a foam. Conventional hydrophilic materials are usable, but their effect could be reinforced by means of so called super-absorbent materials. In accordance with this embodiment, the hydrophilic material absorbs water and effectively blocks water flow from the bottom face of the press fabric.

The dewatering fabric can, in its simplest form, comprise a first layer—the surface layer—and a second layer —the barrier layer—which is situated underneath the surface layer. As a rule, it further comprises at least one base fabric just like prior-art press fabrics. The barrier layer could be a part of this base fabric, but it could also be a completely separate layer, which is needled to or in any other way is interconnected with the base fabric. Further batt layers in addition to said layers could also be included in the dewatering fabric.

DETAILED DESCRIPTION OF THE PREFERRED EMBODIMENTS

Figure 1:
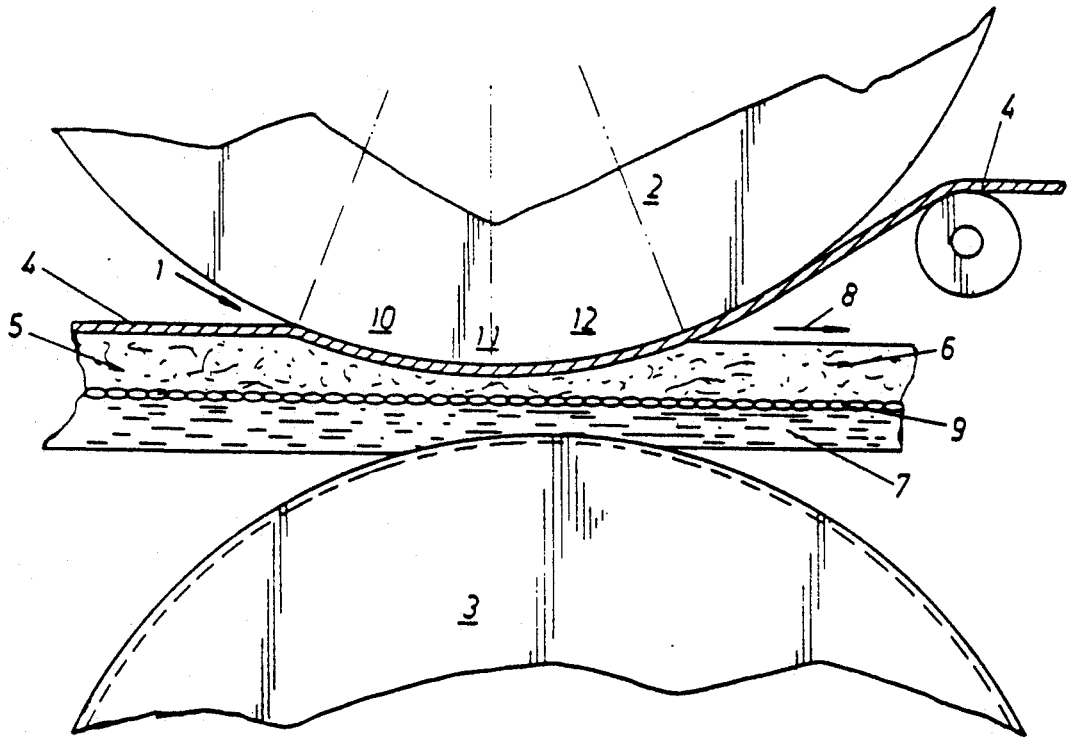
FIG. 1 shows a press nip with a press fabric, equipped with a barrier layer of lengthwise extending fibers in accordance with a first embodiment of the present invention.

With reference to FIG. 1, the press nip 1 comprises a top press roll 2 and a bottom press roll 3. The bottom press roll 3 is preferably formed with cavities in the form of suction holes with vacuum, lengthwise extending grooves (so called Venta or grooved roll press) or blind-drilled holes. A paper web 4 and a press fabric 5 are carried through the press nip 1. The press fabric 5 comprises a first layer 6 (surface layer) of a non-woven batt, positioned in immediate contact with the paper web 4. On the opposite side of the press fabric 5 is arranged a second layer 7 (barrier layer) consisting of a non-woven batt the fibers of which extend mainly in the travelling direction 8 of the press fabric. In another embodiment, shown in FIG. 2, the barrier layer consists of a perforated film 7' with numerous, minute holes. Between the two layers 6, 7 is further arranged a single-layer or double-layer base fabric 9.

The function of the press nip can be considered to have two phases. During the first phase 10, the paper web 4 as well as the press fabric 5 are compressed due to the pressure produced between the press rolls 2,3. In this compression phase 10, the paper web 4 and the first layer (the surface layer) 6 are compressed to near absolute rigidity, as the majority of the void volume and its contents of water and air disappear. The second layer (barrier layer) 7, irrespective of embodiment, can also be heavily compressed during the compression phase 10, while the generally somewhat more incompressible base fabric 9 maintains some of its void volume. Water and air are partly forced from the web 4 and the surface layer 6, down into the limited void volume of the base fabric 9, and partly further through the barrier layer 7 down into the cavities in the bottom press roll 3. Water and air can pass through the barrier layer 7 due to the high pressure that is applied in the press nip 1 between the press rolls 2, 3. When the paper web 4 and the press fabric 5 have been compressed to a maximum, somewhat after the mid point 11 of the press nip 1, the paper web 4 is considered to have reached its maximum dry content. Then the second phase, the expansion phase 12, starts. The paper web 4 and the press fabric 5 expand without admission of air, and a vacuum is created in different parts of the press fabric 5. The highest vacuum is created in the surface layer 6, which has been totally compressed during the phase of maximum pressure. To reestablish the balance, available water tends to flow into the regions with the highest vacuum. In the first embodiment according to FIG. 1, a high vacuum is created in the barrier layer 7 at the same time, as the layer has a high capillary force in the thickness direction due to the lengthwise extending fibers. The barrier layer 7 absorbs water from the base fabric 9 and the cavities in the bottom press roll 3. This water can then flow in the lengthwise direction of the layer due to the low flow resistance that is present in this direction. The vacuum in the surface layer 6 is maintained to a significant degree because the barrier layer 7, owing to its high flow resistance in the thickness direction, its water content and the prevailing high capillary force, effectively prevents water from passing through the rear face of the layer 7 and into the surface layer 6 due to the vacuum that is created therein. Consequently the paper web 4 may not be rewetted to any noticeable extent and, as a result, a paper sheet is obtained having higher dry contents than would otherwise have been possible.

The described embodiments of the invention are to be considered as example only, and a number of modifications are possible. The barrier layer 7 can be made in different forms in accordance with the embodiments described above. The barrier layer 7 could also be arranged in another position in the thickness of the felt, but is always underneath the surface layer 6.

It has been noted above that, as a rule, the press fabrics of the present invention include at least one base fabric 9, more than one base fabric 9 being present where the press fabric is laminated. Each base fabric 9, when included in the press fabric of the invention, may be of interwoven lengthwise and crosswise yarns, the lengthwise yarns being in the direction of travel of the press fabric on the papermachine and the crosswise yarns being transverse to that direction. The base fabrics may be either single- or multilayered, and, where appropriate, may include elements of the barrier layer 7. For example, where the barrier layer 7 is of essentially untwisted bunches of fine filament threads, such threads may be included within the base fabric 9 in its lengthwise direction. In any event, the base fabric, or fabrics, 9 may be woven from yarns of a synthetic, polymeric resin. Monofilaments, plied monofilaments, and multifilament yarns of polyamide or polyester resins are but some of the many varieties of yarns that would immediately spring to the mind of one skilled in the art as examples.

Figure 2:
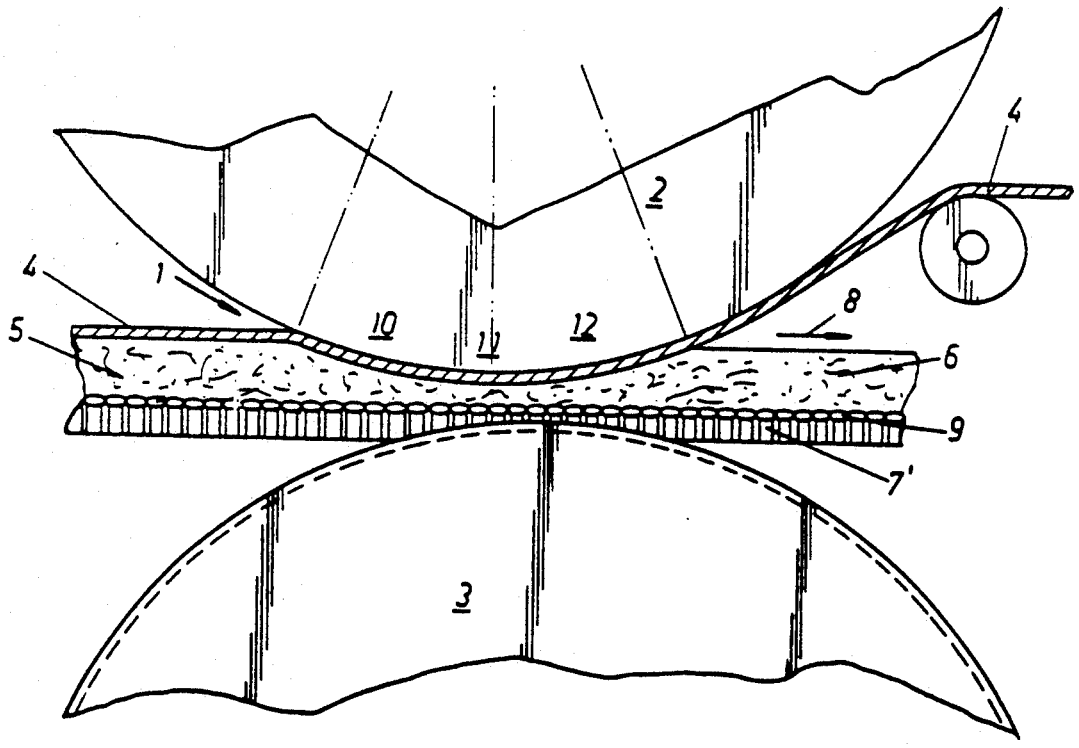
FIG. 2 shows a press nip with a press fabric, equipped with a barrier layer of perforated film with numerous, minute holes.

The base fabric 9 may be between the surface layer 6 and the barrier layer 7, as shown in FIGS. 1 and 2, but may also be below both of these layers in a position on the underside of the base fabric. Alternatively, the press fabric 5 of the present invention may include two base fabrics 9, one between the surface layer 6 and the barrier layer 7, and the other on the underside of the barrier layer 7.

Additional batt layers may also be included in the press fabrics of the present invention. Such additional batt layers may be needled, where suitable, or otherwise attached to the layer, or layers, to which they are adjacent. For example, where an adjacent layer is another non-woven batt, such as that comprising the first, or surface, layer, or where it is an interwoven base fabric, needling may be the appropriate method of attachment. However, where the adjacent layer is a permeable, polymeric foam or a foraminous, polymeric sheet, other means of attachment may be employed, such means being well known and readily available to those skilled in the art.

FIGS. 3A through 3I show several embodiments of the press fabric 5 of the present invention. In its most general form, shown in FIG. 3A, the press fabric 5 includes a surface layer 6 attached to a barrier layer 7.

Figure 3A:
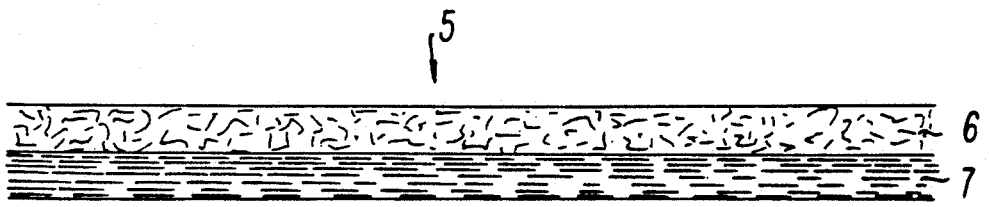
FIG. 3A through 3I show several embodiments of the press fabric of the present invention.
Figure 3B:
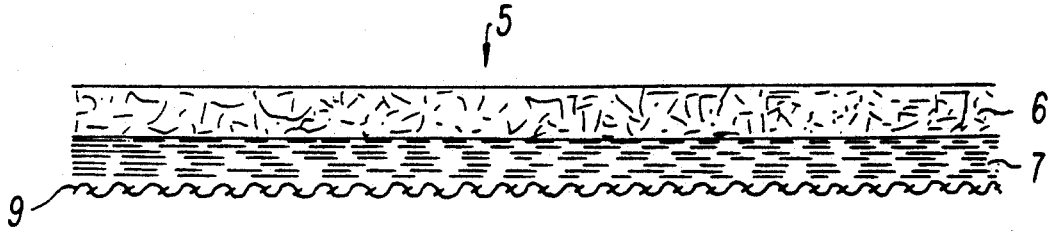

Referring to FIG. 3B, a base fabric 9 may be included on the underside of the barrier layer 7, as well as between the surface layer 6 and the barrier layer 7. It will be recognized that the latter, shown in FIG. 3C, is the same embodiment of the press fabric 5 as is shown in FIGS. 1 and 2.

Figure 3C:
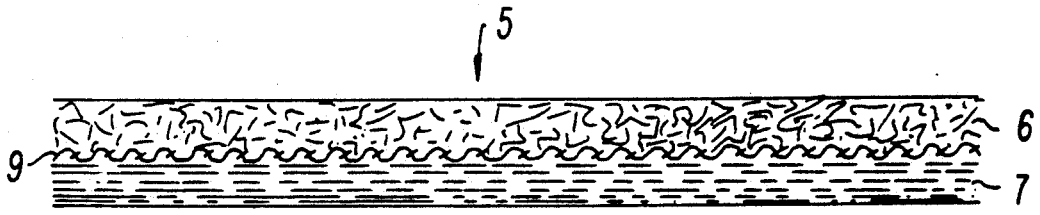
Figure 3D:
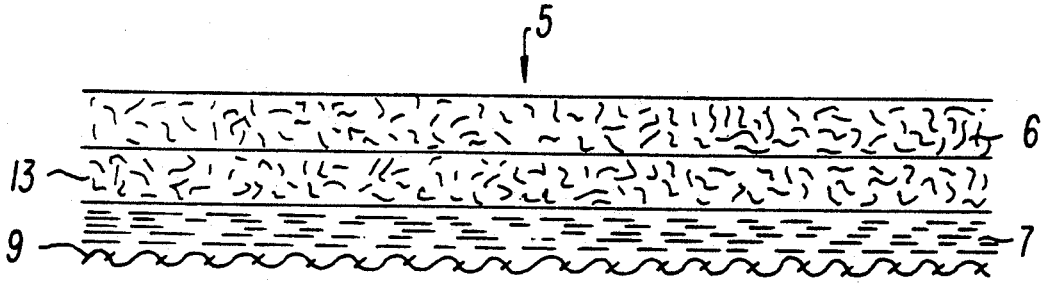
Figure 3E:
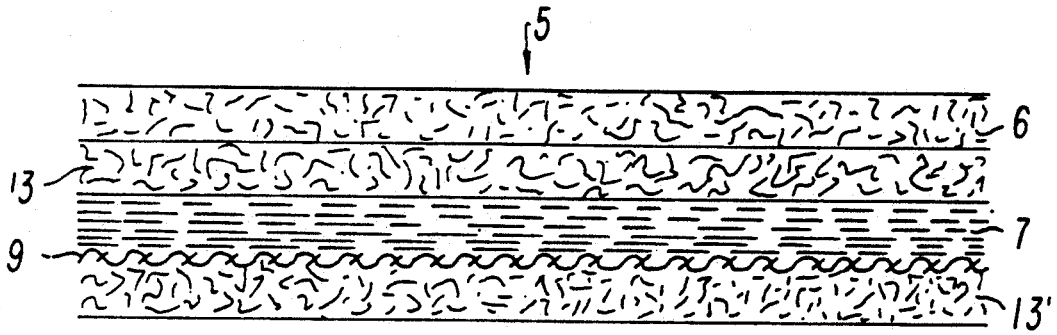

In FIG. 3D, at least one additional batt layer 13 is included between the surface layer 6 and barrier layer 7 in the embodiment of the press fabric 5 shown in FIG. 3B. And again, in FIG. 3E, at least one additional batt layer 13' is included beneath the base fabric 9 in the embodiment shown in FIG. 3D.

Figure 3F:
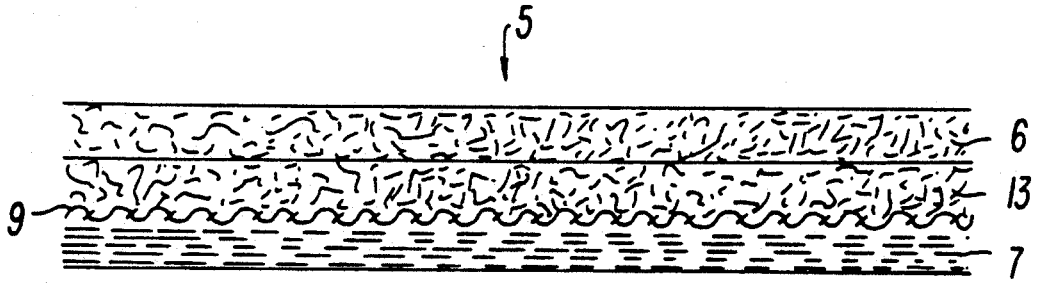
Figure 3G:
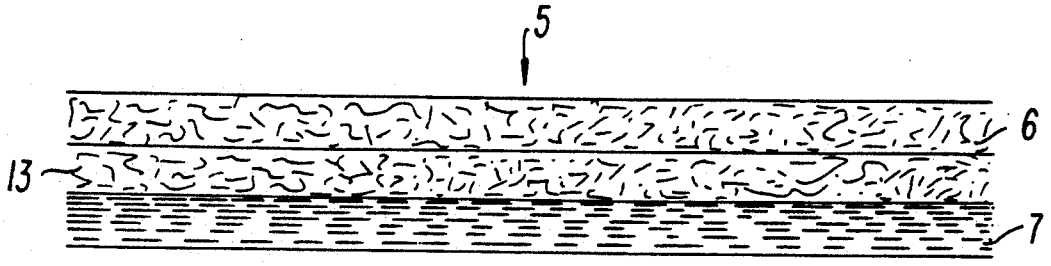

In the embodiment shown in FIG. 3F, at least one additional batt layer 13 is included between the base fabric 9 and the surface layer 6 of the embodiment of the press fabric 5 shown in FIG. 3C. Similarly, at least one additional batt layer 13 is included between the surface layer 6 and barrier layer 7 of the embodiment shown in FIG. 3A to provide the embodiment shown in FIG. 3G. The embodiments shown in FIGS. 3A and 3G ma each further include a base fabric within the structure of the barrier layer 7.

Figure 3H:
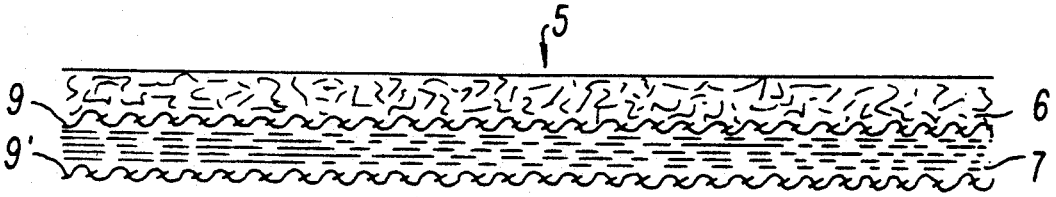
Figure 3I:
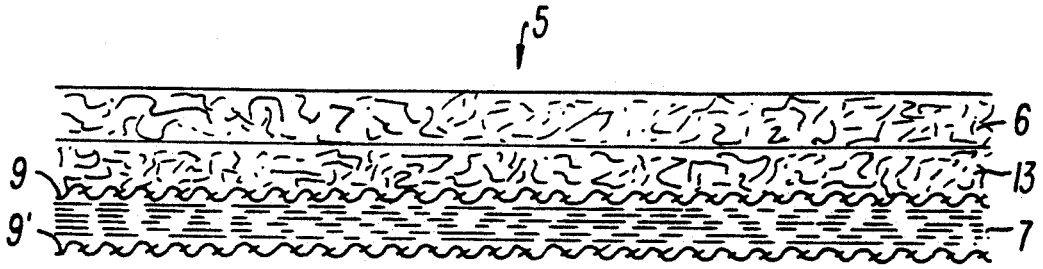

FIGS. 3H and 3I show laminated press fabrics 5 having two base fabrics 9, 9'. In FIG. 3H, a base fabric 9 is included between the surface layer 6 and the barrier layer 7, and another base fabric 9' is included on the underside of the barrier layer 7. The embodiment shown in FIG. 3I differs from that shown in FIG. 3H by the addition of at least one additional batt layer 13 between the surface layer 6 and the base fabric 9.

Many additional embodiments of the present invention, constructed along similar lines, fall within the scope thereof. Modifications to the above would be obvious to those skilled in the art, yet would not bring the invention so modified beyond the scope of the appended claims.

What is claimed is:

1. A press fabric for dewatering a fibrous web in the press section of a papermachine comprising:

a first layer, said first layer being a non-woven batt of staple fibers, said first layer being a surface layer for supporting said fibrous web; and a second layer, said second layer being a barrier layer beneath said surface layer and having a higher flow resistance in the thickness direction than said first layer, said second layer being a non-woven batt of staple fibers to which said first layer is needled, wherein said staple fibers of said second layer are predominantly oriented in the direction of travel of said press fabric on said papermachine.

2. A press fabric as claimed in claim 1 further comprising a first base fabric, said first base fabric being below said second layer, said second layer being attached to said first base fabric.

3. A press fabric as claimed in claim 1 further comprising a first additional layer of non-woven batt of staple fibers, said first additional layer being between said first layer and said second layer and being needled therebetween.

4. A press fabric as claimed in claim 3 further comprising a second base fabric, said second base fabric being between said first additional layer of non-woven batt of staple fibers and said second layer and being attached therebetween.

5. A press fabric as claimed in claim 2 further comprising a second base fabric, said second base fabric being between said first layer and said second layer and being attached therebetween.

6. A press fabric as claimed in claim 2 further comprising a second additional layer of non-woven batt of staple fibers, said second additional layer being below said first base fabric and being attached thereto.

7. A press fabric as claimed in claim 1 wherein said staple fibers of said second layer are hydrophilic.

8. A press fabric for dewatering a fibrous web in the press section of a papermachine comprising:

a first layer, said first layer being a non-woven batt of staple fibers, said first layer being a surface layer for supporting said fibrous web; and a second layer, said second layer being a barrier layer beneath said surface layer and having a higher flow resistance in the thickness direction than said first layer, said second layer being essentially untwisted bunches of fine filament threads oriented in the direction of travel of said press fabric on said papermachine to which said first layer is needled.

9. A press fabric in claim 8 further comprising a first base fabric, said first base fabric being below said second layer, said second layer being connected to said first base fabric.

10. A press fabric as claimed in claim 8 further comprising a first additional layer of non-woven batt of staple fibers, said first additional layer being between said first layer and said second layer and being connected therebetween.

11. A press fabric as claimed in claim 10 further comprising a second base fabric, said second base fabric being between said first additional layer of non-woven batt of staple fibers and said second layer and being attached therebetween.

12. A press fabric as claimed in claim 9 further comprising a second base fabric, said second base fabric being between said first layer and said second layer and being attached therebetween.

13. A press fabric as claimed in claim 9 further comprising a second additional layer of non-woven batt of staple fibers, said second additional layer being below said first base fabric and being attached thereto.

14. A press fabric as claimed in claim 8 wherein said fine filament threads of said second layer are hydrophilic.

15. A press fabric as claimed in claim 9 wherein said first base fabric further comprises essentially untwisted bunches of fine filament threads oriented in the direction of travel of said press fabric on said papermachine.

16. A press fabric as claimed in claim 11 wherein said second base fabric further comprises essentially untwisted bunches of fine filament threads oriented in the direction of travel of said press fabric on said papermachine.

17. A press fabric as claimed in claim 12 wherein said second base fabric further comprises essentially untwisted bunches of fine filament threads oriented in the direction of travel of said press fabric on said papermachine.

18. A press fabric for dewatering a fibrous web in the press section of a papermachine comprising:

a first layer, said first layer being a non-woven batt of staple fibers, said first layer being a surface layer for supporting said fibrous web; and a second layer, said second layer being a barrier layer beneath said surface layer and having a higher flow resistance in the thickness direction than said first layer, said second layer being a foraminous, polymeric sheet with a plurality of channels therethrough for the passage of water from said fibrous web and being attached to said first layer.

19. A press fabric as claimed in claim 18 further comprising a first base fabric, said first base fabric being below said second layer, said second layer being attached to said first base fabric.

20. A press fabric as claimed in claim 18 further comprising a first additional layer of non-woven batt of staple fibers, said first additional layer being between said first layer and said second layer and being needled to said first layer and attached to said second layer.

21. A press fabric as claimed in claim 20 further comprising a second base fabric, said second base fabric being between said first additional layer of non-woven batt of staple fibers and said second layer and being attached therebetween.

22. A press fabric as claimed in claim 19 further comprising a second base fabric, said second base fabric being between said first layer and said second layer and being attached therebetween.

23. A press fabric as claimed in claim 19 further comprising a second additional layer of non-woven batt of staple fibers, said second additional layer being below said first base fabric and being attached thereto.

24. A press fabric as claimed in claim 18 wherein said foraminous, polymeric sheet of said second layer is hydrophilic.

25. A press fabric for dewatering a fibrous web in the press section of a papermachine comprising:

a first layer, said first layer being a non-woven batt of staple fibers, said first layer being a surface layer for supporting said fibrous web; and a second layer, said second layer being a barrier layer beneath said surface layer and having a higher flow resistance in the thickness direction than said first layer, said second layer being a permeable polymeric foam connected to said first layer.

26. A press fabric as claimed in claim 25 further comprising a first base fabric, said first base fabric being below said second layer, said second layer being connected to said first base fabric.

27. A press fabric as claimed in claim 25 further comprising a first additional layer of non-woven batt of staple fibers, said first additional layer being between said first layer and said second layer and being needled to said first layer and connected to said second layer.

28. A press fabric as claimed in claim 27 further comprising a second base fabric, said second base fabric being between said first additional layer of non-woven batt of staple fibers and said second layer and being attached therebetween.

29. A press fabric as claimed in claim 26 further comprising a second base fabric, said second base fabric being between said first layer and said second layer and being attached therebetween.

30. A press fabric as claimed in claim 26 further comprising a second additional layer of non-woven batt of staple fibers, said second additional layer being below said first base fabric and being attached thereto.

31. A press fabric as claimed in claim 25 wherein said permeable polymeric foam of said second layer is hydrophilic.

32. A press fabric for dewatering a fibrous web in the press section of a papermachine comprising:

a first layer, said first layer being a non-woven batt of staple fibers, said first layer being a surface layer for supporting said fibrous web; and a second layer, said second layer being a barrier layer beneath said surface layer and having a higher flow resistance in the thickness direction than said first layer, said second layer being an extremely hydrophilic, synthetic material with a high ability to retain water and being connected to said first layer.

33. A press fabric as claimed in claim 32 further comprising a first base fabric, said first base fabric being below said second layer, said second layer being connected to said first base fabric.

34. A press fabric is claimed in claim 32 further comprising a first additional layer of non-woven batt of staple fibers, said first additional layer being between said first layer and said second layer and being needled to said first layer and connected to said second layer.

35. A press fabric as claimed in claim 34 further comprising a second base fabric, said second base fabric being between said first additional layer of non-woven batt of staple fibers and said second layer and being attached therebetween.

36. A press fabric as claimed in claim 33 further comprising a second base fabric, said second base fabric being between said first layer and said second layer and being attached therebetween.

37. A press fabric as claimed in claim 33 further comprising a second additional layer of non-woven batt of staple fibers, said second additional layer being below said first base fabric and being attached thereto.

* * * * *